United States Patent [19]

Barton

[11] 4,041,946

[45] Aug. 16, 1977

[54] MEDICATED MEMBER FOR PIERCED EARS

[76] Inventor: William R. Barton, 940 Catherine St., Green Bay, Wis. 54301

[21] Appl. No.: 608,776

[22] Filed: Aug. 28, 1975

[51] Int. Cl.[2] ..... A61M 7/00; A61J 1/00

[52] U.S. Cl. ..... 128/260; 128/330; 119/135

[58] Field of Search ..... 128/260, 330, 329; 40/300, 301, 302; 119/106, 135; 24/238, 241 SL

[56] References Cited

U.S. PATENT DOCUMENTS

| | | | |
|---|---|---|---|
| 703,008 | 6/1902 | Scott | 40/302 |
| 1,957,728 | 5/1934 | Rachel | 119/135 |
| 2,612,139 | 9/1952 | Collins | 119/106 |
| 2,713,863 | 7/1955 | Handerson | 128/330 |
| 3,461,587 | 8/1969 | Ham | 40/300 |
| 3,500,829 | 3/1970 | Abramowitz | 128/215 |
| 3,527,223 | 9/1970 | Shein | 128/329 |
| 3,804,088 | 4/1974 | Carroll | 128/260 |

*Primary Examiner*—Aldrich F. Medbery
*Attorney, Agent, or Firm*—Allen D. Brufsky

[57] ABSTRACT

A medicated member that is adapted to be passed through the ear lobe of a pierced ear and to be retained therein thereby speeding the healing of the process.

8 Claims, 5 Drawing Figures

MEDICATED MEMBER FOR PIERCED EARS

BACKGROUND OF THE INVENTION

This invention relates to a medicated member especially adapted for use in conjunction with pierced ears. More particularly, the invention relates to such a member that is especially suited to be maintained in position through the pierced earlobe.

The prior art teaches a variety of medicated members, for example, those disclosed in U.S. Pat. Nos. 2,705,009; 2,283,357; 3,464,413; 3,792,699; and others. The foregoing are, however, not suited for the continuous treatment of an infected or newly pierced ear lobe except by bandaging the same. Instantly, on the other hand, the medicated member functions and appears as a temporary earring thereby not being unsightly yet at the same time being efficacious.

SUMMARY OF THE INVENTION

It is accordingly an object of the instant invention to provide for an improved medicated member especially adapted for use with pierced ears.

It is another object of the invention to provide for the same at relatively little cost thereby making it generally available.

These and other objects of the invention will become more apparent from the following detailed disclosure and claims and by reference to the accompanying drawings, in which:

Figure 1:
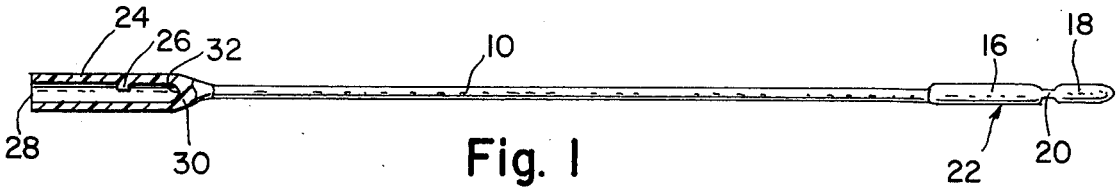
FIG. 1 is a top plan view partly in section.
Figure 2:
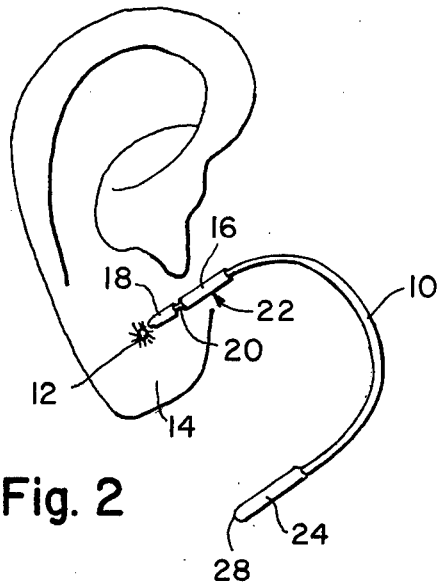
FIGS. 2–5 are perspective views thereof.
Figure 3:
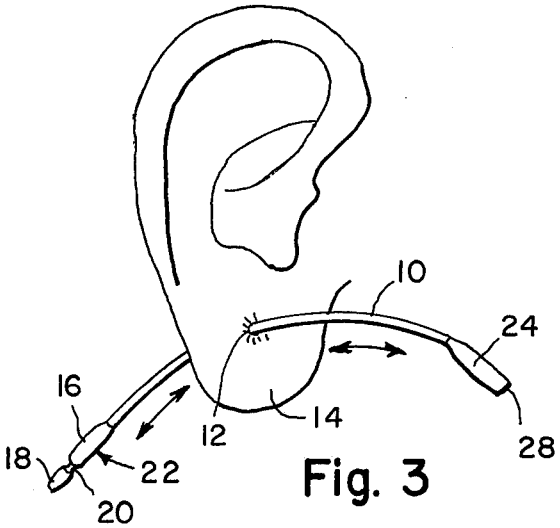
Figure 4:
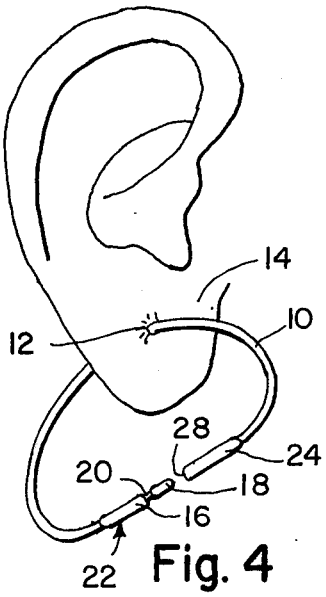
Figure 5:
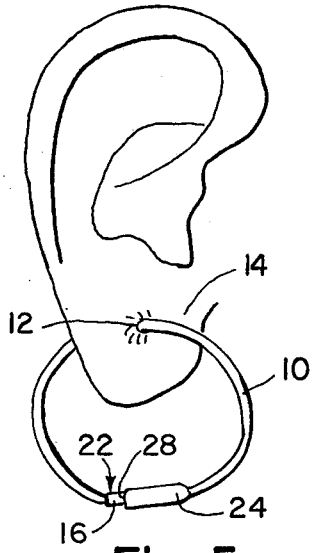

Broadly speaking, the instant invention includes the provision of a medicated unit especially adapted for use in connection with pierced earlobes, comprising an elongated absorbent flexible member having two distal end portions, a first end portion including a jacket portion that defines a sleeve for receiving the distal end and terminating in a generally rounded head section, the head section communicating with the sleeve by a second member having a reduced diameter relative to the sleeve and head section, the second distal end portion including a second exposed sleeve open at one end defining a mouth adapted to receive the head section, the member containing an effective amount of a suitable medicament whereby when the head section engages and passes through the pierced earlobe and is joined to the second sleeve the medicated member is in continuous contact with the pierced earlobe.

DETAILED DISCLOSURE

Referring more particularly to the drawings there is shown an elongated preferably cylindrical, absorbent member 10 that is flexible and may be constructed of any suitable material, woven or nonwoven, the fibrous materials are preferred. In the preferred embodiment the member 10 is sterile as is the remainder of the unit. The diameter of the member 10 will be smaller than that of the aperture 12 of a pierced earlobe 14. One distal end of the member 10 will include a sterile jacket 16 that further includes a leading edge that defines a conical or round tipped shaped probe 18 or the like. The probe or head 18 is preferably constructed of a rigid plastic that is adapted to engage the earlobe 14 aperture 12 without discomfort and pass therethrough, such that the member 10 is in contact therewith. Interposed between the jacket 16 per se and the probe 18 will be an area defining a member 20 of reduced diameter relative to the jacket 16 and probe 18. The jacket 16, probe 18 and member 20 are in the preferred embodiment unitary and generally define a bulbous shaped member 22. The jacket 16 will have a hollow cavity therein of an internal diameter slightly larger than the external diameter of the member 10 such that the former snugly fits into the latter. A suitable adhesive or crimping the mouth of the jacket 16 or the like may be employed to ensure a sure fit. The opposite distal end of the member 10 will include a hollow receiving chamber 24 that is adapted to engage the probe 18 and firmly hold the same therein. A detent of annular internal flange 26 may be provided to snap lock the union, however, merely frictional engagement will suffice in most instances. The chamber 24 has an open mouth 28 at one end that communicates with a sleeve closed at the opposite end 30. The end 30 defines a seat 32 for engagement of the chamber 24 on the distal end of the member 10. In the preferred embodiment there is generally two hemispheres joined back to back thereby effectuating the seat 32.

The chamber 24 may also be constructed of any suitably rigid plastic or like material. The member 10 is impregnated or coated with a suitable medicament or antiseptic, such as an antibiotic or the like. The entire unit may be packaged in a foil or other suitable package for sterility and retention of efficacy.

Since it is obvious that numerous changes and modifications can be made in the above-described details without departing from the spirit and nature of the invention, it is to be understood that all such changes and modifications are included within the scope of the invention.

I claim:

1. A medicated unit especially adapted for use in connection with a pierced earlobe, a means for providing a continuously available supply of medicament to said earlobe comprising an elongated absorbent flexible member of substantially uniform circular cross-section and having a length that is substantially greater than the average thickness of said earlobe, said absorbent flexible member having two distal end portions, a first end portion including a jacket portion that defines a sleeve for receiving said distal end and terminating in a generally rounded head section, said head section communicating with said sleeve by a second member having a reduced diameter relative to said sleeve and head section, said second distal end portion including a second exposed sleeve open at one end defining a mouth adapted to receive said head section and when said ends are joined said elongated absorbent flexible member is shaped to form a continuous loop, said member containing an effective amount of a suitable medicament distributed throughout the length thereof whereby when said medicated elongated absorbent flexible member length engages and passes through said pierced earlobe during normal use and is joined to said second sleeve said medicated member is in continuous movable dispensing contact with and through said pierced earlobe.

2. The unit as defined in claim 1 wherein said first sleeve is unitary.

3. The unit as defined in claim 1 wherein said second sleeve includes an internally disposed flange adapted to engage said head section.

4. The unit as defined in claim 1 wherein said first sleeve is bulbous shaped.

5. The unit as defined in claim 1 wherein said sleeves and said member are substantially cylindrical in shape.

6. The unit as defined in claim 1 wherein said second sleeve includes an internally disposed annular flange.

7. The unit as defined in claim 1 wherein said sleeves are constructed of a rigid material.

8. A package including the unit as defined in claim 1.

* * * * *